United States Patent [19]

Aoki et al.

[11] Patent Number: 4,573,813

[45] Date of Patent: Mar. 4, 1986

[54] RIBBON LIFT DEVICE FOR A PRINTER

[75] Inventors: Hideo Aoki; Kazuaki Takahashi, both of Kodaira, Japan

[73] Assignee: Silver Seiko, Ltd., Japan

[21] Appl. No.: 692,244

[22] Filed: Jan. 17, 1985

[30] Foreign Application Priority Data

Jan. 17, 1984 [JP] Japan ..... 59-4867

[51] Int. Cl.[4] ..... B41J 35/22

[52] U.S. Cl. ..... 400/214; 400/216.1

[58] Field of Search ..... 400/211, 212, 214, 215, 400/216, 216.1

[56] References Cited

U.S. PATENT DOCUMENTS 4,436,192 3/1984 Longrod ..... 400/214 X 4,472,073 9/1984 Valle et al. ..... 400/214 X

FOREIGN PATENT DOCUMENTS 0126183 7/1983 Japan ..... 400/215

*Primary Examiner*—Edgar S. Burr

*Assistant Examiner*—John A. Weresh

*Attorney, Agent, or Firm*—Lane and Aitken

[57] ABSTRACT

A ribbon lift device for selectively positioning a print ribbon and a correction ribbon to a print position for printing or correction of a character includes a first cam having a cam groove formed therein for lifting the print ribbon to the print position and a second cam having a cam profile for lifting the correction ribbon to the print position. Means are provided for coupling the first and second cams such that forward rotation of the first cam will not rotate the second cam but reverse rotation of the first cam will rotate the second cam in the same direction, and a bidirectional electric motor is coupled to the first cam whereby rotation of the motor will lift the print ribbon or the correction ribbon, depending upon the direction of rotation.

11 Claims, 5 Drawing Figures

RIBBON LIFT DEVICE FOR A PRINTER

BACKGROUND OF THE INVENTION

This invention relates to a ribbon lift device for a printer for selectively moving a print ribbon and a correction or erase ribbon to a print or correction allowing position by means of a cam mechanism.

Ribbon lift devices of the type described above are known in the art, and a typical one of such conventional device is disclosed, for example, in Japanese laid-open Pat. No. 56-161190. The conventional device includes a single controlling cam which has a common cam track and separate cam tracks corresponding to a print ribbon and a correction or erase ribbon formed therein so that rotation of the controlling cam in a forward or reverse direction may selectively displace the print ribbon or the correction ribbon to a print position for printing of a character or for correction of a character printed. However, since the conventional device is designed so as to attain different selective operations by forward or reverse rotation of the single controlling cam, an arrangement or construction of such cam tracks, a cam follower and so on becomes complicated and must be made in high accuracy, resulting in difficulty in production and assembly. Besides, it has another drawback that detection of a position of the controlling cam and controlling such as controlling of an amount of rotation of the controlling cam inevitably become complicated and difficult.

SUMMARY OF THE INVENTION

The present invention has been made to eliminate such drawbacks of conventional ribbon lift devices and provides a ribbon lift device which comprises a bidirectional drive motor, a shaft coupled to be rotated by a drive motor and having a reference position for rotation, a first cam mounted for integral rotation on the shaft and having a cam groove formed on a face perpendicular to the shaft, a cam follower mounted on a base member for a print ribbon and a correction or erase ribbon and in engagement with the cam groove of the first cam, the cam groove of the first cam having a first portion which moves, when the shaft is rotated in a first direction from the reference position, the base member to position the print ribbon to a print position, a second cam mounted for rotation on and relative to the shaft, and coupling means for coupling the shaft to the second cam such that rotation of the shaft in a second direction opposite to the first direction will rotate the second cam in integral relationship and yet the second cam will not be rotated by rotation of the shaft in the first direction, and the second cam having a cam lobe which acts on the cam follower to move, when the shaft is rotated in the second direction from the reference position, the base member to position the print ribbon to the print position.

Other aspects of the invention will become apparent as the following description proceeds and upon reference to the drawing.

DETAILED DESCRIPTION OF THE PREFERRED EMBODIMENT

Figure 1:
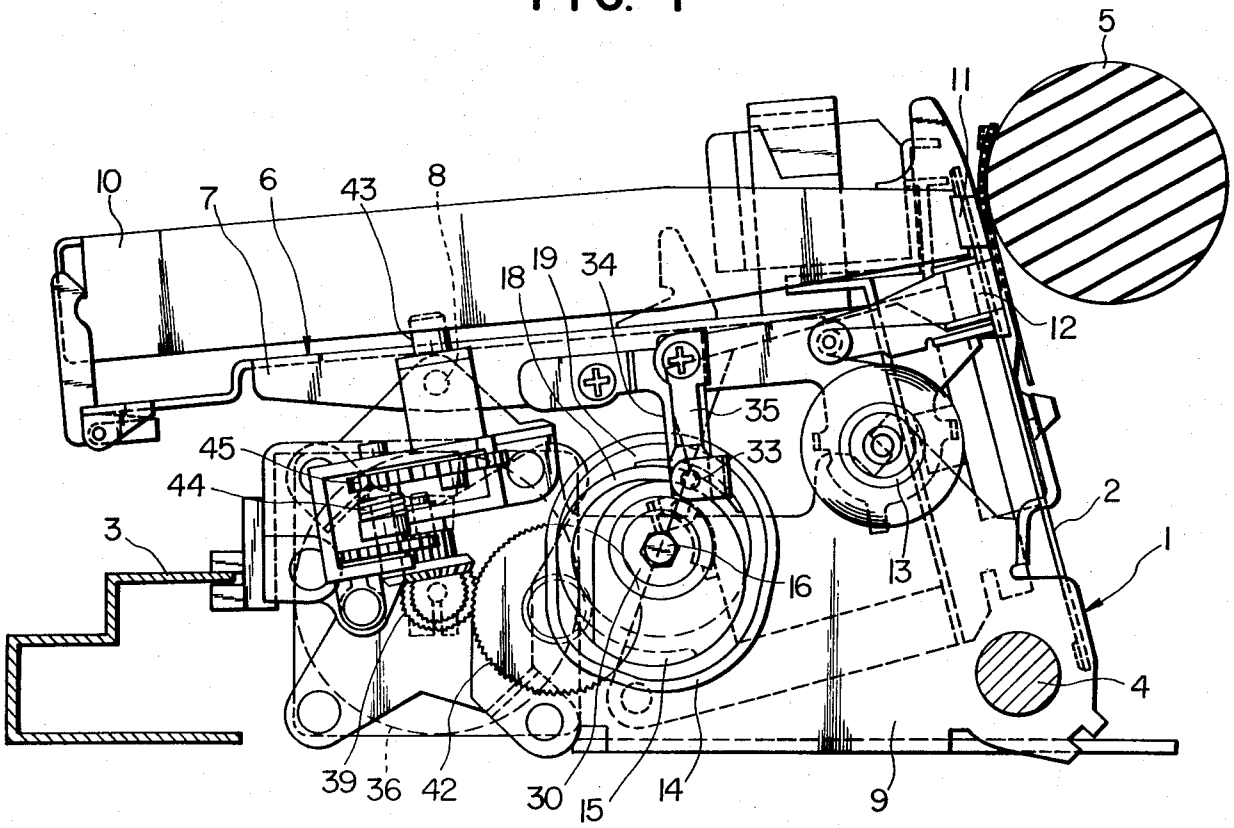
FIG. 1 is a side elevational view showing a print ribbon and a correction ribbon in their respective stand-by positions.

A daisy wheel type wheel 2 adapted to be rotated by a stepping motor is mounted on a carrier 1 which is supported at a forward portion thereof on a guide rail 3 and at a rearward portion thereof on a guide rod 4 for movement in parallel with a platen 5.

A ribbon lift arm 6 is mounted on the carrier 1 and has a substantially U-shape in plan opened at a rear side thereof. The ribbon lift arm 6 has a pair of integral left and right side plates 7 (the left side one is omitted) and is supported at forward portions of the side plates 7 thereof for pivotal motion on a pair of left and right side plates 9 (the left side one is omitted) of the carrier 1 by means of a shaft 8.

A ribbon cassette 10 is removably mounted on the ribbon lift arm 6 and a print ribbon 11 therefrom extends over and a little behind the type wheel 2.

A correction or erase ribbon 12 extends between a pair of spools 13 (only one is shown) mounted for rotation at rear portions of the left and right side walls 7 of the ribbon lift arm 6 and located a little behind the type wheel 2 and just below the print ribbon 11.

First and second cam members 14 and 15 are provided for the print ribbon 11 and the correction ribbon 12, respectively, and are mounted for rotation substantially at a central portion of the right side plate 9 of the carrier 1 by means of a pivot 16.

The first cam member 14 is in the form of a substantially elliptical plate made of a suitable synthetic resin material and has formed in a front face thereof an inner cam groove 18 which is a little eccentric relative to a shaft hole 17 at the center of the first cam member 14 and an outer cam groove 19 which is substantially elliptical and is partially in common with the inner cam groove 18.

In particular, the outer cam groove 19 is different at upper and lower portions thereof from the inner cam groove 18 and is in common at middle portions thereof with the inner cam groove 18, the inner and outer cam grooves 18 and 19 are different in depth, that is, stepped, at branching portions thereof from each other.

A wedge-shaped coupling cam 20 having an inclined face is formed on an annular recessed portion inside of the inner cam groove 18 of the first cam member 14, and a gear 21 is provided in integral relationship on a rear face of the first cam member 14.

Meanwhile, the second cam member 15 is in the form of a partially removed circular plate or disk made of a synthetic resin material and has a pair of wedge-shaped controlling cams 23 each having an inclined face provided integrally at diametrically symmetrical positions relative to a shaft hole 22 on a front face thereof while it has a wedge-shaped coupling cam 20 provided on a rear face thereof corresponding to the coupling cam 20 of the first cam member 14.

A controlling member 25 in the form of a disk for controlling rotation of the second cam member 15 has a tubular spring receiving portion 26 integrally provided at a central portion of a front face thereof and has a hexagonal shaft hole 27 formed at the center thereof and extending through the spring receiving portion 26. The controlling member 25 further has a pair of wedge-shaped controlling cams 28 provided at diametrically symmetrical positions relative to the shaft hole 27 on a rear face thereof corresponding to the controlling cams 23 of the second cam member 15.

The support shaft 16 has a circular cross section at a rear portion thereof and a hexagonal cross section at a front portion thereof. The rear portion of the support shaft 16 extends through the shaft holes 17 and 22 of the first and second cam members 14 and 15, respectively, while the front portion of the shaft hole 16 extends through the shaft hole of the controlling member 25, a coil spring 29 and a spring receiving ring 30. A pair of snap rings 31 are mounted forwardly of the spring receiving ring 30 and rearwardly of the first cam member 14 on the support shaft 16. The support shaft 16 is threaded at a rear end portion thereof which extends through a hole formed in the right side plate 9 and is screwed into a nut 32 so as to mount the support shaft 16 in a horizontal direction on an outer side of the right side plate 9.

Thus, the first and second cam members 14 and 15 are supported for individual rotation and for axial sliding movement on the support shaft 16 while the controlling member 25 is supported for axial sliding movement on the support shaft 16 but not for rotational movement relative to the support shaft 16.

The controlling member 25 is normally urged toward and into engagement with the second cam member 15 by means of a coil spring 29 which is loosely fitted on an outer periphery of the spring receiving portion 26 of the controlling member 25 and is located between the controlling cam 25 and the spring receiving ring 30. By this arrangement of the coil spring 29, the controlling member 25 and the first and second cam members 14 and 15 are urged in a same direction and are thus held in predetermined mutually neighboring positions thereof.

A cam follower 33 in the form of a pin is fitted for sliding movement in a through-hole formed in a support arm 34 mounted on the right side plate 9 of the ribbon lift arm 6 and extends in parallel with and is located above an axis of the support shaft 16. The cam follower pin 33 is urged in an axial direction by a spring plate 35 so that an end thereof is held fitted in the inner or outer cam groove 18 or 19 of the first cam member 14.

A stepping motor 36 is mounted at a forward portion of an inner face of the right side wall 9 of the carrier 1. An outer end portion of a rotary shaft of the stepping motor 36 extends outwardly through the right side plate 9 and has a spur gear 38 and a bevel gear 39 mounted thereon. A rotary encoder 40 is mounted at the other end of the rotary shaft 37 of the stepping motor 36.

A photosensor 41 is mounted on the carrier 1 for detecting operation of the rotary encoder 40.

A gear 42 is mounted on the right side plate 9 and is located between and in meshed engagement with the gears 39 and 21 so that rotation of the stepping motor 36 will rotate the first cam member 14 in a corresponding direction via those gear 38, 42 and 21.

A winding shaft 43 for the print ribbon 11 is mounted on the right side plate of the carrier 1 and is connected to the gear 39 by way of a feed mechanism 45 including a spring clutch 44 and a plurality of gears such that only forward rotation of the stepping motor 36 will rotate the winding shaft 43 to wind up the ink ribbon 11.

Figure 2:
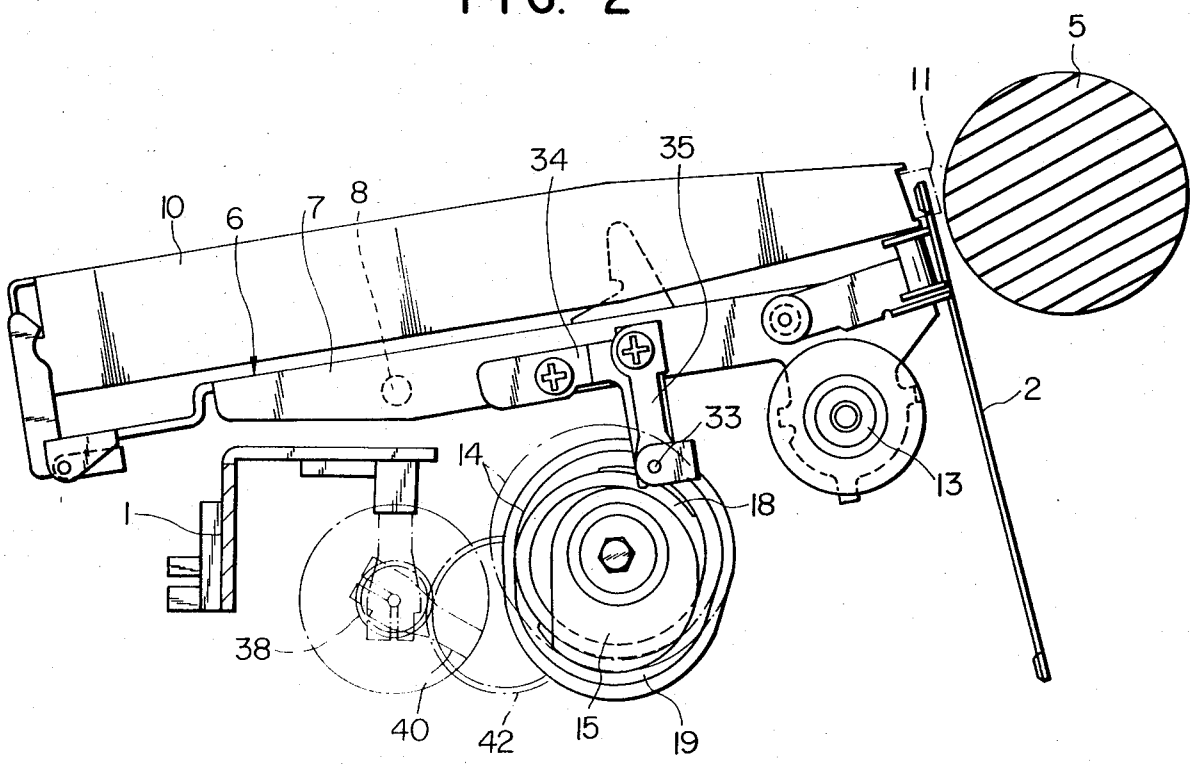
FIG. 2 is a side elevational view showing the print ribbon in its lifted position.

The cam follower 33 is normally at a stand-by position in the inner cam groove 18 of the first cam member 14 and thus the print ribbon 11 and the correction ribbon 12 are in respective stand-by positions thereof (FIG. 1). When a character is to be printed, the stepping motor 36 is rotated one complete rotation in the forward direction so that the first cam member 14 is rotated by an angle of 120 degrees in the forward direction to a position as shown in phantom in FIG. 2. In the meantime, the cam follower 33 is guided to the larger diameter portion of the inner cam groove 18 and is thus raised thereby so that the ribbon lift arm 6 is pivoted in the counterclockwise direction to displace the print ribbon 11 to the print position (FIG. 2).

After completion of printing, the stepping motor 36 is rotated in the reverse direction to angularly rotate the first cam member 14 in the reverse direction to its initial or home position so that the cam follower 33 is returned to its stand-by position to return the print ribbon 11 to its stand-by position.

In this case, as the first cam member 14 is rotated in the forward direction and then in the reserve direction, the coupling cam 20 of the first cam member 14 is not engaged with the coupling cam 24 of the second cam member 15 since they are so positioned relatively while the second cam member 15 is held to its stand-by position (FIGS. 1 and 2) without being rotated due to engagement of the controlling cams 23 and 29 on the second cam member 15 and the controlling member 25, respectively. Meanwhile, the print ribbon 11 is fed by an increment by the rotation of the first cam member 14 in the forward direction.

On the other hand, when printing is to be performed repetitively, the first cam member 14 is rotated by an angle of 120 degrees for each printing operation, and as the first cam member 14 is rotated by an angle of 360 degrees in the forward direction (the full line position in FIG. 2), the cam follower 33 is in the outer cam groove 19 outwardly of the stand-by position thereof. Thus, while the first cam member 14 is rotated one complete rotation in the forward direction, the print ribbon 11 is held to the printing position since the upper half or larger diameter portion of the outer cam groove 19 and the lower half or smaller diameter portion of the inner cam groove 18 as seen in FIG. 1 along which the cam follower 14 is guided for the rotation extend substantially along a circle. In case the first cam member 14 is rotated successively or continuously rotated in the forward direction, the coupling cam 20 of the first cam member 14 is engaged, during such successive rotations, at an inclined face thereof with an inclined face of the coupling cam 24 of the second cam member 15 so that the second cam member 15 is displaced axially away from the first cam member 14 against the urging of the coil spring 29 and is not rotated by the latter. After the coupling cams 20 and 24 are disengaged from each other, the second cam member 15 is axially returned to its original position by the coil spring 29.

After completion of such repetitive printing, the stepping motor 36 will be rotated in the reverse direction until the first cam member 14 is returned to its original or home position. During this reverse rotation of the first cam member 14, the cam follower 33 is guided into the inner cam groove 18 to its stand-by position due to an offset or difference in depth of the inner and outer cam grooves 18 and 19 at a joining point therebetween.

Figure 3:
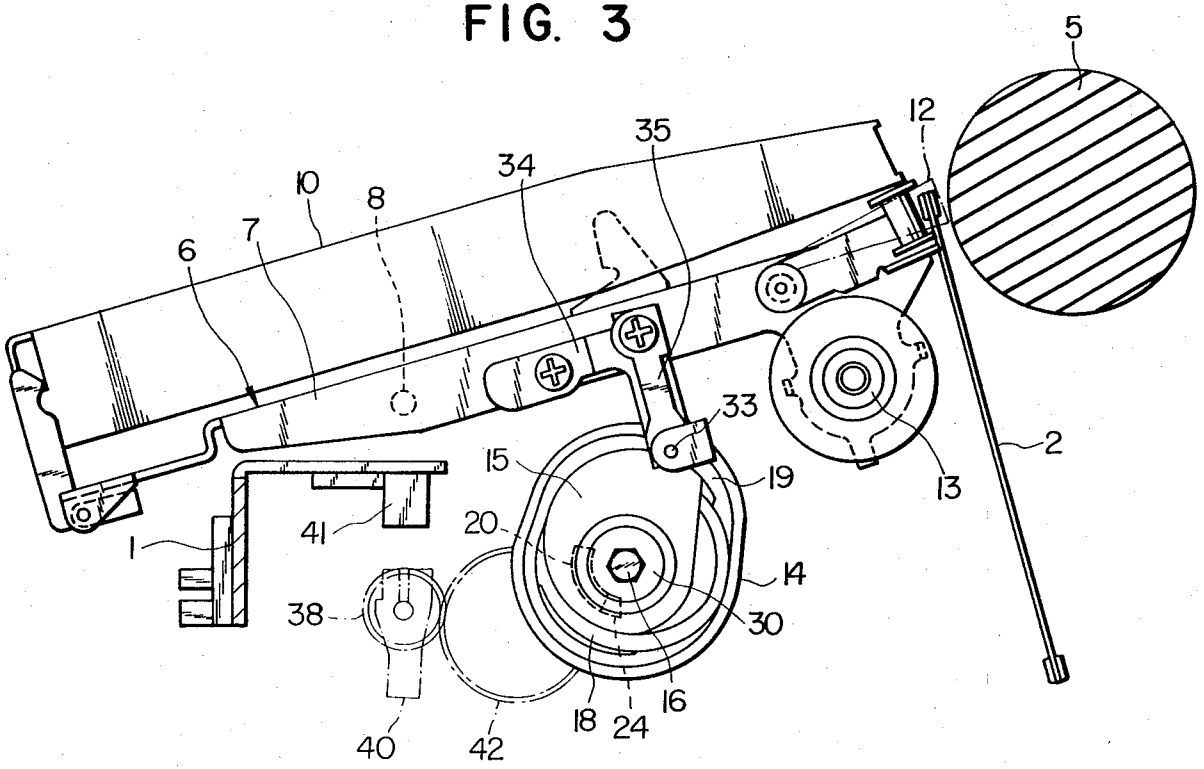
FIG. 3 is a similar side elevational view showing the correction ribbon in its lifted position.
Figure 4:
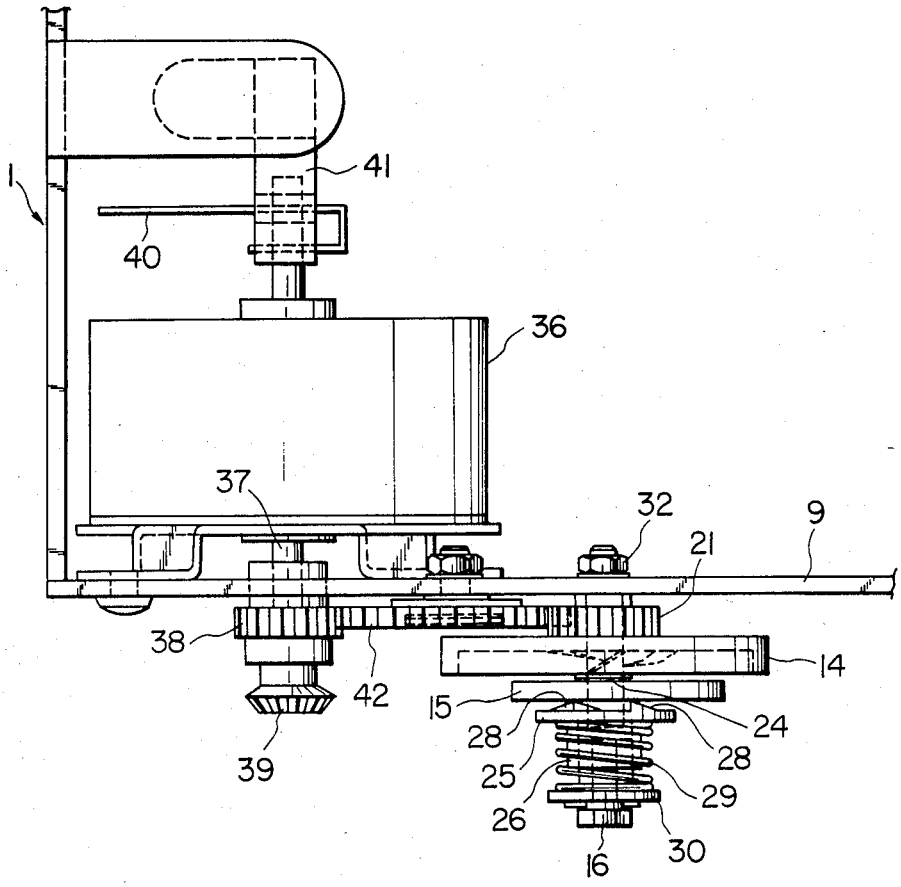
FIG. 4 is a plan view showing first and second cam members, and a stepping motor.
Figure 5:
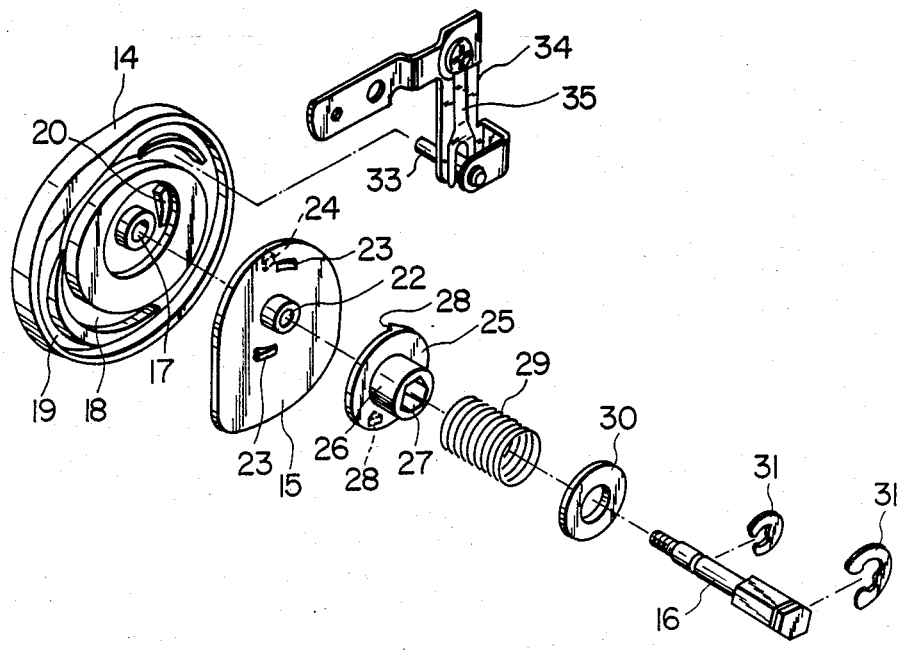
FIG. 5 is a fragmentary perspective view showing the first and second cam members, a controlling member, and a coil spring.

Further, when a correcting or erasing operation is to be effected, the stepping motor 36 is rotated in the reverse direction to rotate the first cam member 14 by a complete rotation in the reverse direction. During this reverse rotation, the coupling cams 20 and 24 are abutted with each other to couple the first and second cam members 14 and 15 so that the second cam member 15 is rotated in the counterclockwise direction (FIG. 1). Thus, while the second cam member 15 is rotated substantially by a half rotation in the reverse direction, the cam follower 33 is guided to and is thus lifted by the larger diameter portion or cam lobe of the second cam member 15 (the cam follower 33 is simultaneously guided to the larger diameter portion of the outer cam groove 19) to a position (FIG. 3) higher than the position to which it is lifted during printing as described hereinabove.

As the cam follower 33 is thus lifted, the ribbon lift arm 6 is pivoted in the counterclockwise direction to position the correction ribbon 12 to the printing position for correction of a typed character. In this case, since the controlling cams 23 and 28 are engaged at their inclined faces with each other to axially displace the controlling member 25 against the urging of the coil spring 29, rotation of the second cam member 15 is not prevented by the controlling member 25.

After completion of erasing of a character typed in error, the second cam member 15 is then rotated the remaining part of the one complete rotation, that is, substantially another half rotation, to return to its home position while the cam follower 33 is returned to its stand-by position in the inner cam groove 18 to return the correction ribbon 12 to its stand-by position.

As the correction ribbon 12 is returned to its stand-by position, it will be fed by an increment by a feed mechanism (not shown) which is operated by the ribbon lift arm 6.

As apparent from the foregoing description, according to the present invention, a print ribbon and a correction ribbon are lifted to a print position for printing or correction of a character by means of a first and a second cam member corresponding to the print and correction ribbons. Accordingly, when compared with a conventional ribbon lift device which includes a single cam for controlling lifting of a print ribbon and a correction ribbon, the first and second cam members can be made in simplified construction to thus simplify the construction of the entire device. Detection of positions of the first and second cam members and controlling such as controlling of an amount of rotation of the first and second cam members can also be facilitated, thus eliminating such drawbacks of the conventional device as described hereinabove.

In addition, since the second cam member is rotated by the first cam member when the first cam member is rotated in the reverse direction, there is no need of individual provision of drive devices for these cams and hence the device of the invention is economical.

What is claimed is:

1. A ribbon lift device for selectively moving a base member to position a print ribbon and a correction ribbon supported thereon to a print position to allow printing with said print ribbon or said correction ribbon, comprising:

a bidirectional drive motor;

a first cam coupled to be rotated by said drive motor and having a reference position for rotation;

said first cam having a cam groove formed on a face thereof;

a cam follower mounted on said base member and in engagement with said cam groove of said first cam;

said cam groove of said first cam having a first portion which moves, when said cam is rotated in a first direction from said reference position, said base member to position said print ribbon to said print position;

a second cam mounted for rotation relative to said first cam; and coupling means for coupling said first cam to said second cam such that rotation of said first cam in a second direction opposite to said first direction will rotate said second cam in integral relationship and yet said second cam will not be rotated by rotation of said first cam in said first direction; and said second cam having a cam lobe which acts on said cam follower to move, when said first cam is rotated in said second direction from said reference position, said base member to position said correction ribbon to said print position.

2. A ribbon lift device as claimed in claim 1, wherein said first portion of said cam groove of said first cam is such that rotation of said first cam by an angle in said first direction from and then in said second direction to said reference position will position said print ribbon to said print position and then out of said print position.

3. A ribbon lift device as claimed in claim 2, wherein said cam groove of said first cam has a second portion formed in continuous and eccentric relationship to said first portion and extending substantially in an entire circle around the axis of rotation of said first cam such that successive continuous rotations of said first cam in said first direction will hold said print ribbon to said print position.

4. A ribbon lift device as claimed in claim 3, wherein said cam follower is in the form of a pin mounted on said base member and extending in parallel with the axis of rotation of said first cam, said pin being spring-urged into engagement with said cam groove of said first cam, and wherein said second portion of said first cam has, adjacent a joining point thereof with said first portion, a bottom which is displaced in an axial direction of said axis from a bottom of said first portion such that said cam follower pin will not be allowed to be introduced into said second portion from said first portion when said first cam is rotated in said second direction.

5. A ribbon lift device as claimed in any one of the claims 2 to 4, further comprising a gear train coupling said drive motor to said first cam such that a predetermined number of rotations of said drive motor will rotate said first cam one complete rotation, and means for detecting a reference position of said drive motor, said means for detecting including a member mounted for integral rotation on said drive motor and a sensor positioned to detect said member.

6. A ribbon lift device as claimed in claim 5, wherein said gear train is such that one complete rotation of said drive motor will rotate said shaft substantially by an angle of 120 degrees.

7. A ribbon lift device as claimed in any one of claims 1–4, wherein said cam lobe of said second cam is formed to bring said cam follower out of said first portion of said cam groove at an initial part of rotation of said first cam in said second direction from said reference position and then to allow said cam follower to be introduced again into said first portion of said cam groove of said first cam.

8. A ribbon lift device as claimed in claim 1, wherein said coupling means comprises a first coupling cam surface on said first cam facing said second cam and a second coupling cam surface on said second cam facing first cam and positioned to engage said first coupling cam surface, spring means to resiliently urge said second cam toward said first cam, said first and second coupling cam surfaces being shaped to permit rotation of said first cam relative to said second cam in said first direction, but prevent rotation of said first cam in said second direction relative to said second cam so that said second cam is rotated with said first cam when said first cam is rotated in said second direction.

9. A ribbon lift device as recited in claim 8, wherein said coupling cam surfaces are wedge shaped and arranged so that said coupling cam surfaces will slide over each other axially displacing said second cam against the force of said spring means when said first cam is rotated in said first direction relative to said second cam.

10. A ribbon lift device as recited in claim 8, wherein said coupling means further comprises means to prevent rotation of said second cam in said first direction.

11. A ribbon lift device as claimed in claim 1, wherein said first cam and second cam are rotatably mounted on a shaft, said coupling means comprising a first coupling cam surface on said first cam facing said second cam, a second coupling cam surface on said second cam facing said first cam positioned to engage said first coupling surface, and a spring surrounding said shaft and urging said second cam toward said first cam, said first and second coupling cam surfaces being shaped to permit said first cam to rotate in said first direction on said shaft relative to said second cam, but to prevent said first cam from rotating on said shaft relative to said second cam in said second direction so that when said first cam is rotated in said second direction, it causes said second cam to rotate in said second direction.

* * * * *